US007973490B2

(12) United States Patent
Archdekin

(10) Patent No.: US 7,973,490 B2
(45) Date of Patent: Jul. 5, 2011

(54) HID LIGHTING CONTROL WITH TRANSIENT VOLTAGE SENSING AND LAMP RESTARTING, AND METHOD OF MAKING AND USING

(75) Inventor: James M. Archdekin, Ladera Ranch, CA (US)

(73) Assignee: Active ES Lighting Controls, Inc, Laguna Hills, CA (US)

( * ) Notice: Subject to any disclaimer, the term of this patent is extended or adjusted under 35 U.S.C. 154(b) by 460 days.

(21) Appl. No.: 12/154,690

(22) Filed: May 23, 2008

(65) Prior Publication Data

US 2008/0297061 A1 Dec. 4, 2008

Related U.S. Application Data

(60) Provisional application No. 60/932,744, filed on May 31, 2007.

(51) Int. Cl.
*H05B 41/24* (2006.01)
*H05B 37/02* (2006.01)

(52) U.S. Cl. ..... 315/276; 315/307; 315/360; 315/362

(58) Field of Classification Search ..... 315/141, 315/276, 283, 291, 307, 308, 360, 362
See application file for complete search history.

(56) References Cited

U.S. PATENT DOCUMENTS

| | | | | | |
|---|---|---|---|---|---|
| 3,732,460 | A * | 5/1973 | Wattenbach | 315/123 |
| 4,431,948 | A * | 2/1984 | Elder et al. | 315/276 |
| 5,138,234 | A * | 8/1992 | Moisin | 315/209 R |
| 5,477,113 | A * | 12/1995 | Christoffersson | 315/278 |
| 5,508,589 | A * | 4/1996 | Archdekin | 315/149 |
| 5,528,110 | A * | 6/1996 | Archdekin | 315/276 |
| 5,623,186 | A * | 4/1997 | Archdekin | 315/276 |
| 5,856,905 | A * | 1/1999 | Eckel et al. | 361/187 |
| 5,932,997 | A * | 8/1999 | James | 323/351 |
| 6,583,574 | B2 * | 6/2003 | Ann et al. | 315/149 |
| 7,084,587 | B2 * | 8/2006 | Archdekin et al. | 315/309 |

* cited by examiner

*Primary Examiner* — Thuy Vinh Tran
(74) *Attorney, Agent, or Firm* — Terry L. Miller

(57) ABSTRACT

A voltage control apparatus (10) for an HID lamp includes a voltage control transformer circuit (20), and is connected between supply mains (22) and a high intensity discharge (HID) lamp. The HID lamp is started at full line voltage, and after a sufficient operating interval ensuring that the lamp has achieved a sustaining temperature, the operating voltage applied to the lamp is reduced, effecting considerable savings in energy use, with little or only an acceptably small decrease in light output from the lamp. Further, the voltage control apparatus include a circuit portion responsive to voltage transients on the AC line, and which effects restarting of the HID lamp in the event a voltage transient occurs which is sufficiently long (i.e., about ½ cycle) as to extinguish the HID lamp.

16 Claims, 6 Drawing Sheets

HID LIGHTING CONTROL WITH TRANSIENT VOLTAGE SENSING AND LAMP RESTARTING, AND METHOD OF MAKING AND USING

CROSS REFERENCE TO RELATED APPLICATION

This application is related to, and claims benefit of and priority under 35 USC §119(c) from U.S. provisional application No. 60/932,744, filed 31 May 2007.

BACKGROUND OF THE INVENTION

1. Field of the Invention

The present invention, broadly considered, is in the field of lighting control. More particularly, the present invention pertains to a voltage control load center for control of the voltage applied to high intensity discharge lamps. The voltage control load center includes plural modular transformer circuits, each controlling the voltage applied to an HID lamp or group of such lamps. Further, this invention relates to such a modular voltage control transformer circuit, and to methods of making and using both the voltage control load center and the modular transformer circuit.

2. Related Technology

The present invention constitutes an improvement over prior art U.S. Pat. No. 4,431,948, issued Feb. 14, 1984, and also over U.S. Pat. Nos. 5,528,110; 5,508,589; and 5,623,186, the disclosures of which are incorporated herein by reference to the extent necessary for a full disclosure and understanding of the present invention.

The '948 patent discloses a controller for HID lighting effecting a selective reduction of applied voltage by use of an autotransformer connected in series with a switch. A first portion of the autotransformer winding is interposed between the input and the output, and an additional winding portion is interposed between the output and the common or neutral terminal of an alternating current power source. The first portion of winding is referred to the series winding of the autotransformer, and the second portion of the winding is referred to as the common winding of the autotransformer. The switch (which may be implemented as a relay, for example), is connected in series with the common winding so that when the relay is in its open condition, no current flows in the common winding, and the output voltage is substantially equivalent to the input voltage.

On the other hand, according to the '948 patent, when the switch contacts of the relay are closed current is permitted to flow in the common winding and the autotransformer performs its normal function with the output voltage reduced relative to the input voltage. However, the invention of the '948 patent has significant deficiencies, as is pointed out in the three later patents identified above.

In the three later patents identified above, an inventive autotransformer is provided with a bucking coil in order to cancel the creation of harmonics and inadvertent heating affects in the autotransformer. This inventive autotransformer avoids the deficiencies of the '948 patent. However, further improvements to the technology for controlling HID lighting are possible. There is, therefore, a need to provide an improved apparatus and method for control of HID lighting in order to achieve lowered power consumption.

All prior voltage control transformer circuits known to the Applicant were designed for specific applications, and were sized for those applications. Thus, each application or installation of such a voltage control transformer circuit for HID lighting was to a greater or lesser extent a custom design and a custom (i.e., application specific) installation.

Further, because many locations have line power which is not particularly "clean" (i.e., which includes undesirable transients in voltage or current supply, or in power factor) it is desirable to provide an HID lighting control which can sense those transients, and when a particular transient is sufficiently large that the HID lamp is extinguished, the control implements a timing scheme to effectively re-start the HID lamp.

Further, it would be an advantage to have a voltage control load center for HID lighting which provided for plural such modular voltage control transformer circuits to be arranged for convenient connection to existing or newly installed HID lighting units.

SUMMARY OF THE INVENTION

In view of the deficiencies of the related technology, it is an object for this invention to reduce or eliminate at least one of these deficiencies.

Particularly, it is an object of this invention to provide a modular voltage control transformer circuit.

A further object of this invention is to provide a voltage control load center for HID lighting, which is responsive to transients in the line voltage and which will re-start the HID lamp in the event a particular transient is sufficiently large that the lamp is extinguished.

A further object of this invention is to provide a voltage control load center for HID lighting, which allows for the installation of plural such modular voltage control transformer circuits, and for their convenient connection to HID lighting units.

Accordingly, one particularly preferred embodiment of the present invention provides a modular voltage control transformer circuit.

Another particularly preferred embodiment of the present invention provides a voltage control load center including plural modular voltage control transformer circuits.

And further, the present invention provides the inventive method of utilizing a modular voltage control transformer circuit to control operating voltage applied to an HID lamp.

These and other objects and advantages of the present invention will be more fully understood from a consideration of the following disclosure of particularly preferred exemplary embodiments of the invention, taken in conjunction with the appended drawing Figures.

DETAILED DESCRIPTION OF PREFERRED EXEMPLARY EMBODIMENTS

Figure 1:
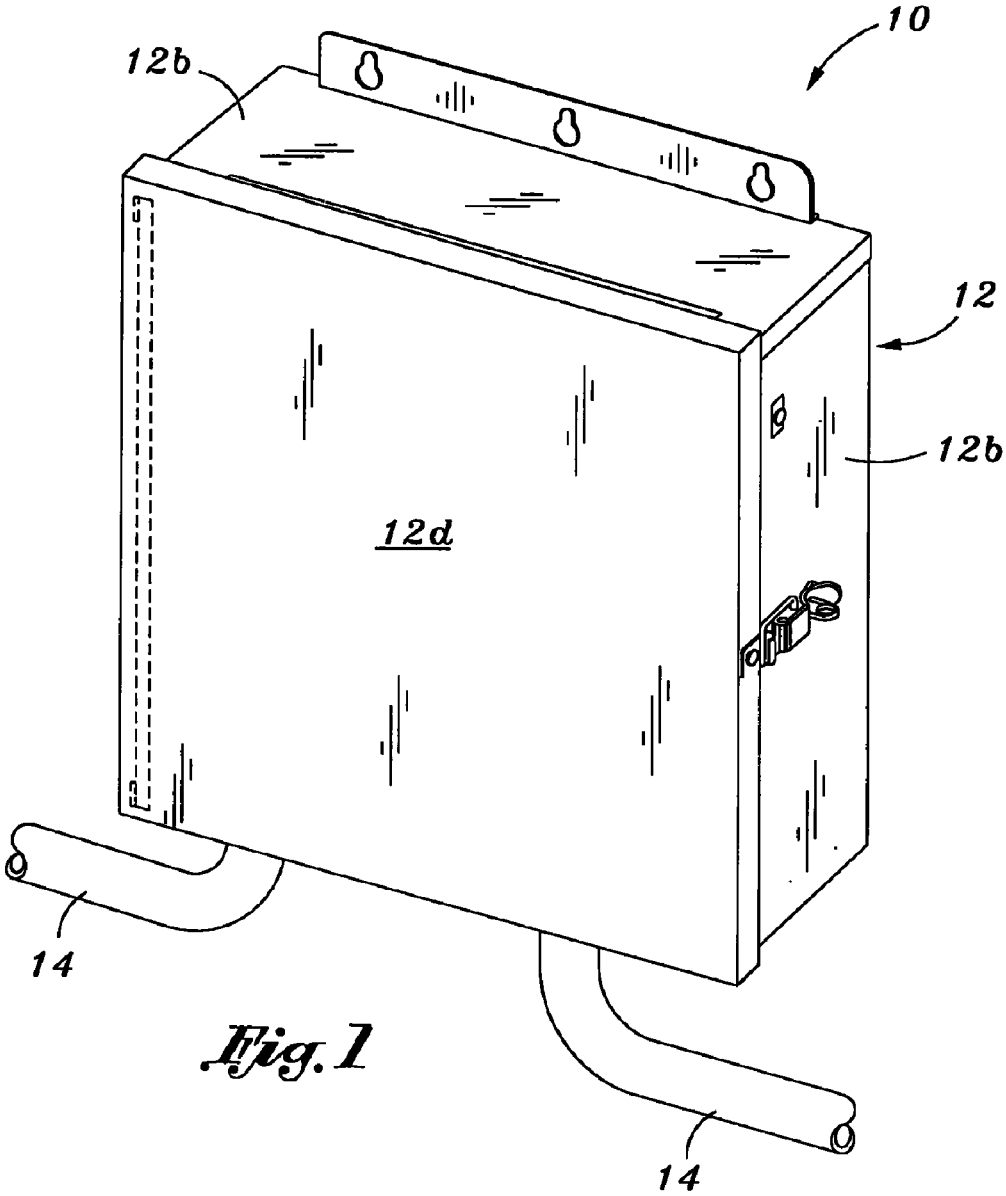
FIG. 1 provides an exterior perspective elevation view of a voltage control load center, which includes plural modular voltage control transformer circuits for HID lighting.
Figure 2:
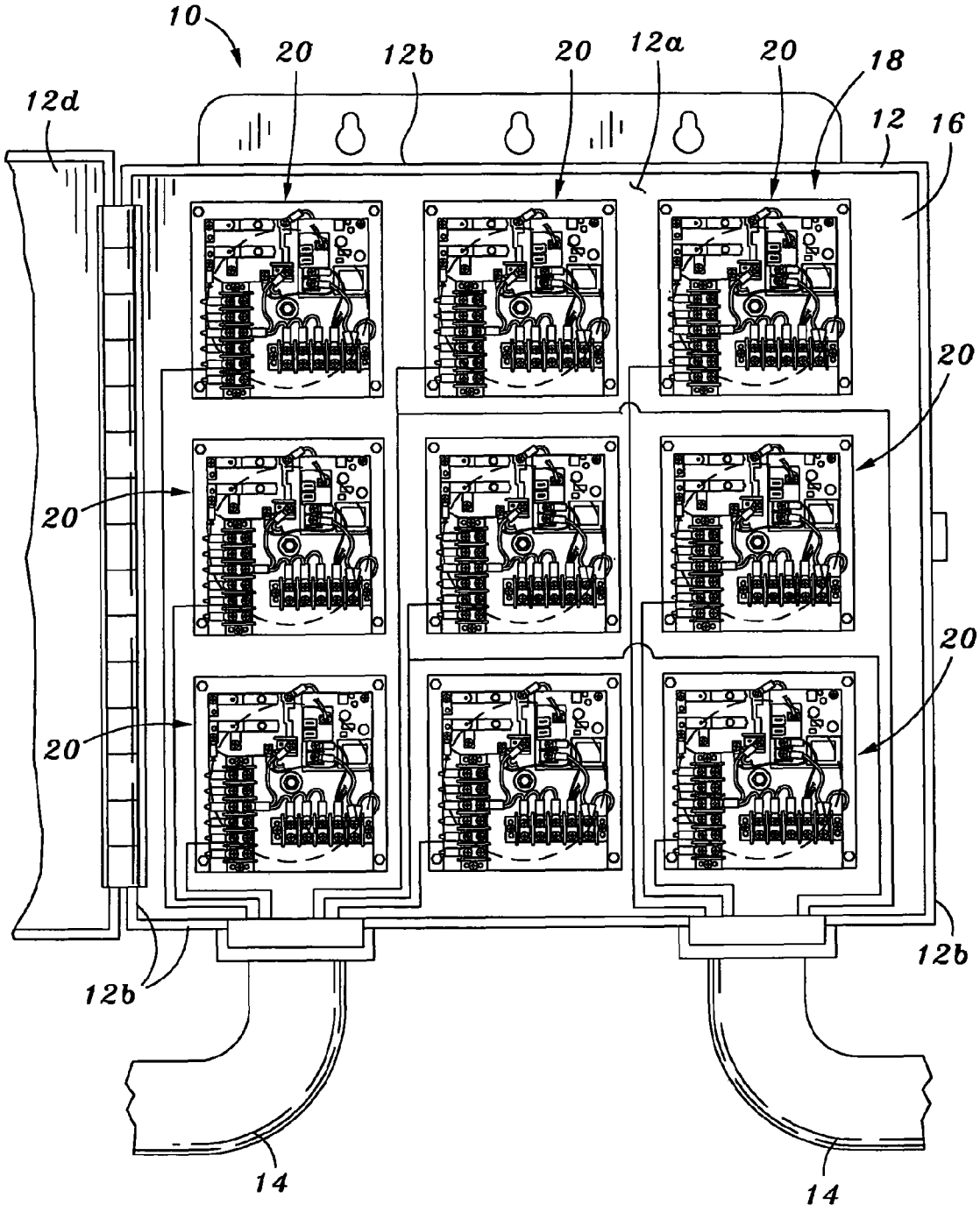
FIG. 2 provides a elevation view of the voltage control load center seen in FIG. 1, with the door of the load center opened (and partially broken away for convenience of illustration), to show the plural modular voltage control transformer circuits disposed in this load center.

Referring to FIGS. 1 and 2 in conjunction, a voltage control load center 10 includes a protective metal box or enclosure 12. This box 12 is most usually mounted to a wall (not seen in the drawing Figures), and has plural electrical conduits 14 (each housing electrical wiring) connecting thereto. The box 12 includes a rear portion 12*a* with peripheral walls (i.e., top, bottom, and side walls) each indicated with the numeral 12*b*, and a rear wall 12*c* (best seen in FIG. 2). A cover 12*d* (or front wall of the box 12) is hingeably or removably attached to the rear portion 12*a*. In FIG. 2, the cover 12*d* is shown hinged open (and partially broken away for convenience of illustration). As FIG. 2 illustrates, the box 12 encloses a volume, referenced with the numeral 16. Received within the box 12, in the volume 16, is an array 18 of plural modular voltage control transformer circuits (MVCTC's), each indicated individually with the numeral 20. Because each of the MVCTC's is essentially identical, description of one of these circuits will suffice to describe them all. As is best seen in FIG. 2, these MVCTC's are connected to wiring entering the box via the conduits 14. As will be further explained, each of the MVCTC's 20 includes a terminal strip to which certain ones of the wires are connected, as will be better understood in view of the following description.

Figure 3:
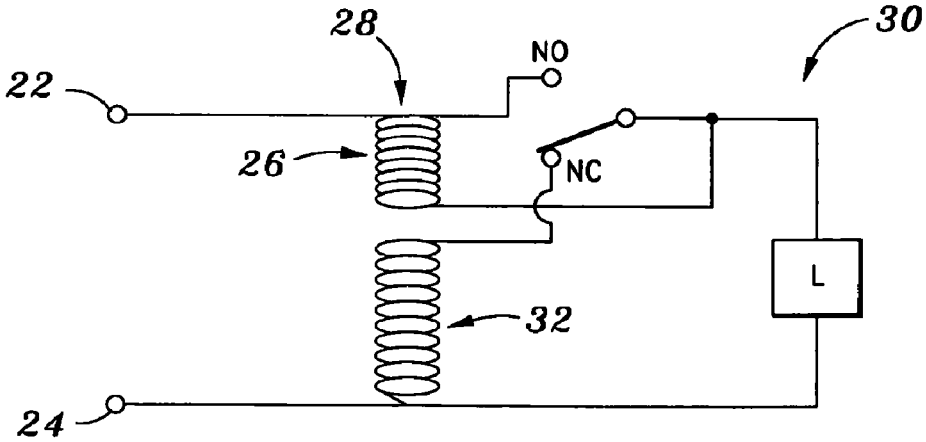
FIG. 3 is a simplified schematic of a portion of the modular voltage control transformer circuit.

FIG. 3 provides a simplified schematic of the circuit defined by a supply line (i.e., from the AC power mains) in combination with one of the MVCTC's 20, and in combination with a load, which is most preferably a high intensity discharge (HID) lamp (or a group of such HID lamps). Viewing FIG. 3, it is seen that the line voltage is received over two wires, indicated with numerals 22 and 24 (with 22 being the line, and 24 being common). In order to proved an initial understanding of the voltage control load center 10, attention now to FIG. 3, will show that wire 22 is connected to one side of the primary (i.e., series) winding 26 of a transformer 28. The other side of this transformer winding 26 is connected to an HID lighting unit, indicated with the character "L" standing for "load." The other connection of the HID lighting unit L is connected to the other wire 24. So, whenever line voltage is applied to the wires 22 and 24, the HID lighting unit L will receive voltage. However, the voltage level received by the HID lighting unit L is controlled by the operation of the MVCTC 20, and particularly is controlled by the operation of transformer 28.

It is seen that the MVCTC 20 illustrated in FIG. 3 includes a single-pole, double-throw (SPDT) switch 30 having a common contact connecting to the other side of the winding 26, and to the lighting unit L. This SPDT switch 30 includes a normally open (NO) contact which is connected to the wire 22 and to the first end of primary winding 26. Similarly, the SPDT switch 30 includes a normally closed (NC) contact which is connected to one end of a secondary (i.e., parallel) winding 32 of the transformer 28.

The other end of this secondary winding 32 is connected to the wire 24, and to the other side of the load L.

So, those ordinarily skilled in the pertinent arts will recognize that when the SPDT switch 30 (which may preferably be provided as a relay) is not energized, and the NC contacts are closed, the transformer 28 functions as a conventional autotransformer, and delivers a reduced voltage to the lighting unit L. Viewed differently, when the NC contacts of SPDT switch (relay) 30 are closed, the relay 30 provides power from wire 22 to the first end of winding 32. The windings 26 and 32 are magnetically coupled (i.e., as is common in transformers), and the winding 32 is arranged to buck or resist or to decrease (as opposed to boosting) the voltage across winding 26. Consequently, the load L receives a voltage which is less than the voltage applied to the mains on wires 22 and 24. On the other hand, when the NO contacts of this relay 30 are closed, then the relay shorts the primary winding 26, but delivers full voltage from wire 22 to the lighting unit L. When the NC contacts of the relay 28 or 30 are closed a reduced voltage level delivered to the lighting unit L will be a ratio of line voltage generally according to the turns ratio of winding 32 compared to the total turns of windings 26 and 32 together. And, importantly, because of the configuration of the circuit seen in FIG. 3, the transition from full voltage applied to lighting unit L, to a reduced voltage applied to this lighting unit, occurs without an interruption of current flow to the lighting unit. Thus, there is no tendency for the HID lighting unit L to be extinguished because of even a temporary interruption of current flow. Current flow is continuous during the voltage reduction desired after warm up of the HID lighting unit L.

Now, in order to provide for full voltage starting of the HID lighting unit L, followed by a sufficient warm up interval of operation at full voltage in order to insure that the lighting unit L can remain lighted when voltage level is reduced for sustained operation, a timing device is most preferably utilized, and is programmed or selected to provide a sufficiently long warm up interval that the HID lighting unit (i.e., load L) will have achieved sustaining temperature so that the unit does not extinguish when the applied operating voltage is reduced. This time interval may be a variable, depending on such facts as the extent of the voltage reduction (and energy savings) desired, and the ambient temperature where the HID lamps are located.

Figure 5:
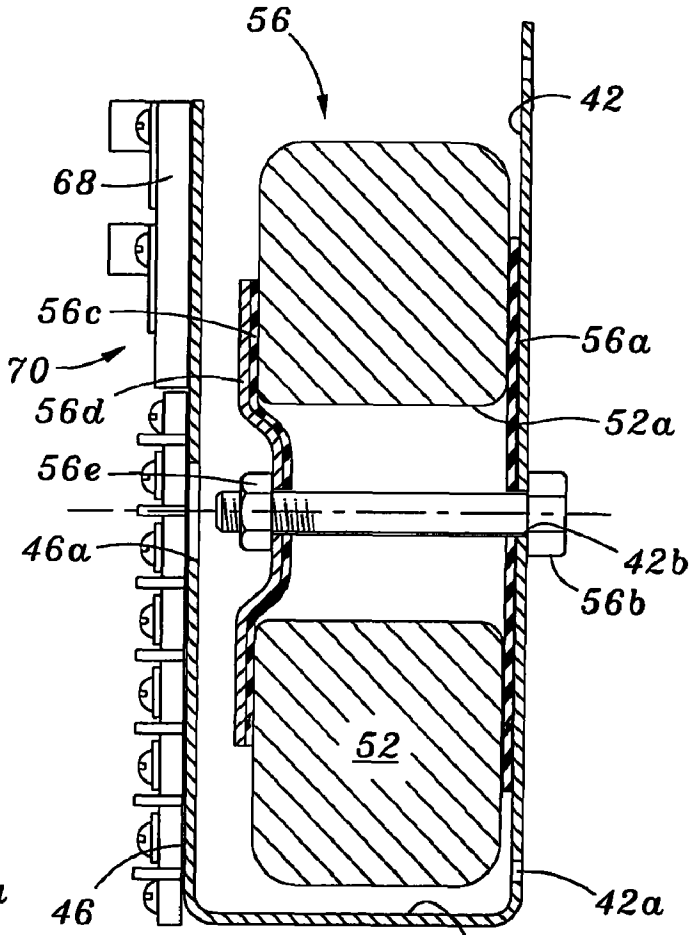
FIGS. 4 and 5, respectively, are a side elevation view and a front elevation view of a modular voltage control transformer circuit according to the present invention.
Figure 4:
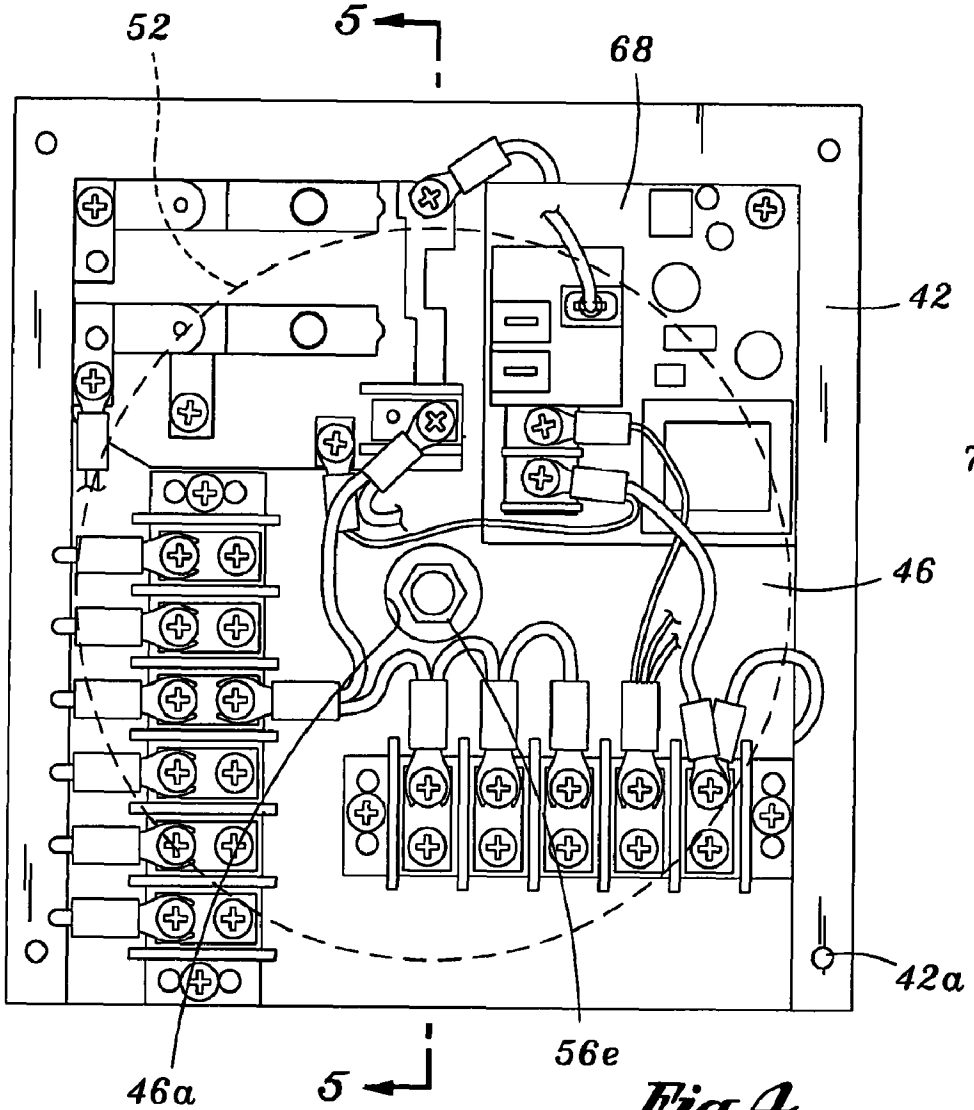
Figure 6:
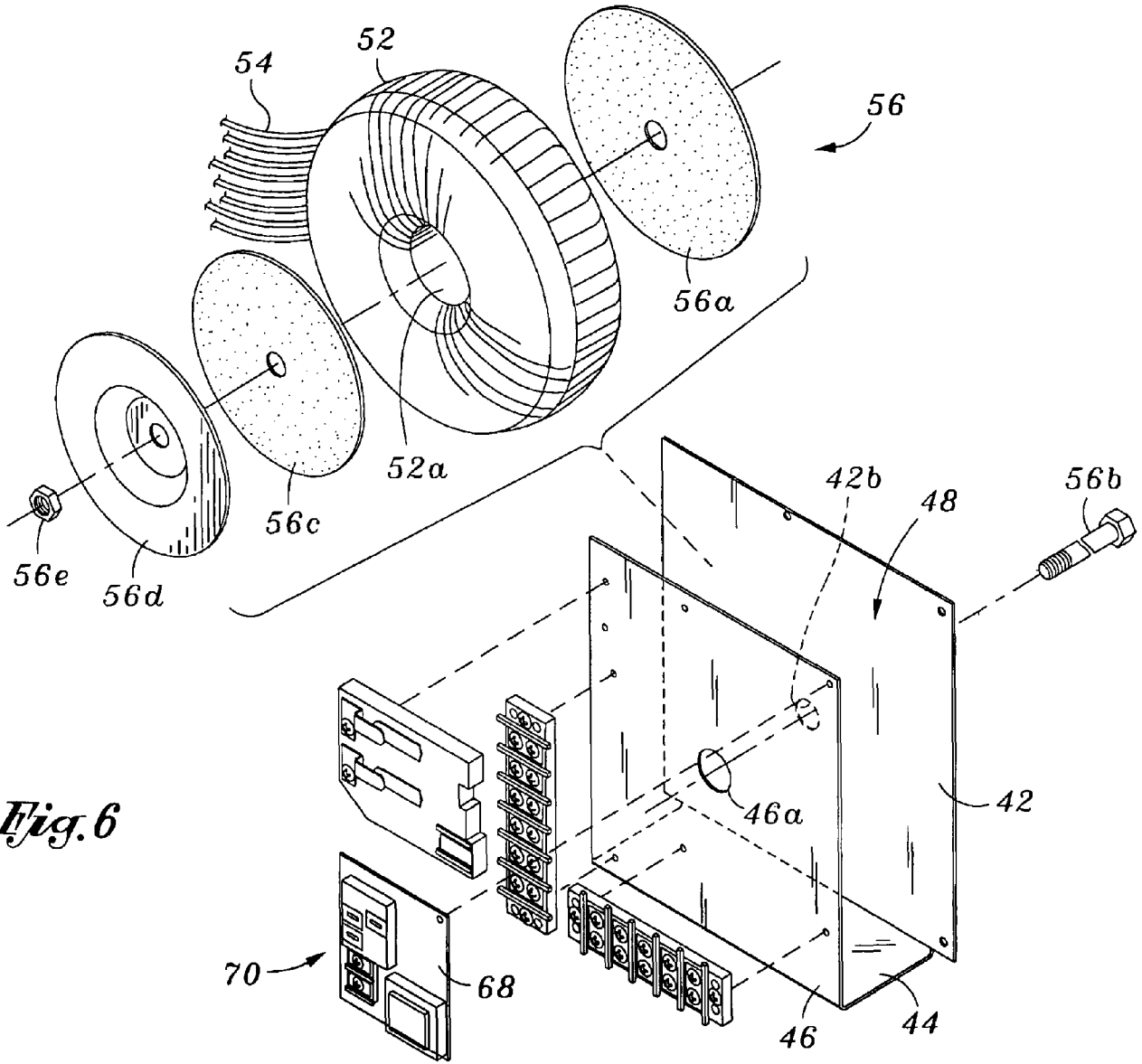
FIG. 6 provides an exploded perspective view of a modular voltage control transformer circuit as seen in FIGS. 2-6.

Considering now FIGS. 4-6 in conjunction, it is seen that the modular voltage control transformer circuit (MVCTC) 20 includes a base 40, which is generally rectangular or square in front view, and is U-shaped in side view. The base 40 includes a generally rectangular back plate portion 42, which defines mounting holes 42*a* by which the MVCTC 20 can be secured to the back wall 12*a* of box 12 and within the volume 16. From this back plate portion 42, a connecting leg portion 44 extends forwardly to carry a front plate portion 46. Cooperatively, the back plate portion 42, connector leg portion 44, and front plate portion 46 define a recess 48, (best seen in FIG. 6). An annular or torroidal transformer assembly 50 is receivable into the recess 50. This assembly includes a transformer core and windings 52 having a central passage 52*a*, plural leads 54, and a mounting assembly, generally indicated with the numeral 56 on FIG. 6.

Viewing FIG. 6, it is seen that the mounting assembly 56 includes a rear cushion member 56*a*, (which is elastomeric and insulating) is interposed between the rear plate portion 42 and the transformer 52. As is best seen in FIG. 6, the rear plate portion 42 defines a centrally located bolt hole 42*b*, and a bolt 56*b* is received through this hole 42*b* to receive the cushion member 56*a*. Next, the transformer core 52 is received over the bolt 56*b*, followed by another cushion member 56*c* (which is also elastomeric and insulating), a dimpled washer member 56*d*, and a nut 56*e* to secure these components in place. It is seen that the dimpled washer 56*d* includes a central conical offset 56*d*', which is sized to be received into the central passage 52*a* of the annular transformer 52. As is best seen in FIG. 6, but visible also in FIGS. 4 and 5, the front plate portion 46 defines a centrally located opening 46*a* aligned with the bolt hole 42*b*, and by which access to the nut 54*e* is facilitated in order to effect secure mounting of the transformer 52 within the recess 48. Thus, the transformer 52 is supported by rear plate portion 42, but is received into recess 48 so that the leads 54 are easily accessed at the front plate portion 46.

As FIGS. 4-6 illustrate, these leads from transformer 52 are trained around the edge of front plate portion 46, and are there secured to a connector strip 60 carried on the front plate portion 46. This connector strip 60, and a second connector strip 62 also carried on the front plate portion 46, provide for connection of electrical wiring to the MVCTC 20, as was generally illustrated and described by reference to FIG. 2. Also carried on the front of front plate portion 46 is a control circuitry for the MVCTC 20, and which is generally referenced with the numeral 64. This control circuit 64 includes a relay 66, which provides the SPDT switch 30 explained with reference to FIG. 3. That is, the relay 66 includes a set of Normally Open (NO), and a set of Normally Closed (NC) contacts which operate as explained above to change the voltage provided to a load connected to the MVCTC 20. Also carried on the front plate portion 46 on a circuit board 68 is a timing circuit 70 controlling operation of the relay 66. That is, the timing circuit 70 is arranged to start a count-down time interval when power is applied to the MVCTC 20, and to accordingly operate the load (i.e., HID lamps connected to the MVCTC 20) at full line voltage for a determined time interval after the power is turned on. So, the HID lamps will start and operate at full line voltage for this determined time interval, ensuring that the lamps are sufficiently hot that they do not extinguish when the applied voltage is decreased by the MVCTC 20. After this time interval, the MVCTC 20 operates relay 66 to result in the voltage applied to the HID lamps being reduced to a level lower than full line voltage. This results in little or only an acceptably small reduction in light output from the HID lamps, but results in a significant energy savings.

As a result, when the HID lighting units connected to MVCTC 20 are started at full line voltage, and are thereafter provided with a period of operation at full line voltage during which the lighting units warm from ambient temperature to achieve a temperature sufficient to sustain operation at a reduced voltage level, the timing circuit 70 conducts a count-down of the determined time interval. The time interval is selected such that the lighting units are sufficiently hot to sustain operation at reduced voltage.

Figure 7:
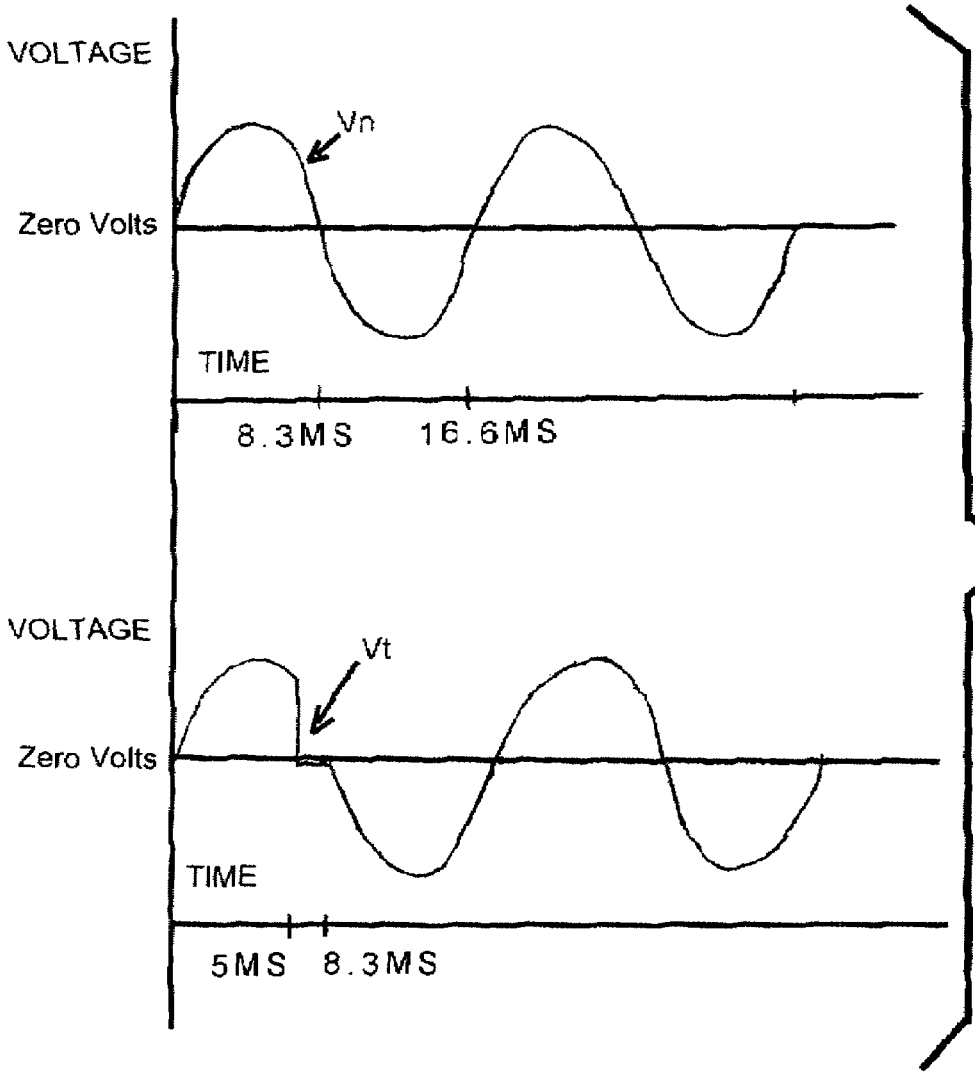
FIG. 7 provides an exemplary time-versus-voltage diagram, on which a typical or normal operating voltage waveform, and a transient voltage waveform, are both illustrated.

Turning now to FIG. 7, a time-versus-voltage diagram is provided on which the sinusoidal line Vn indicates the normal voltage waveform expected on the AC supply line. However, voltage waveform Vt also shown on this diagram indicates a voltage transient, which may result, for example, from another customer or user on the line switching a heavy load (such as a large industrial processing machine or equipment) onto the line. As a result of the heavy load suddenly applied to the line, the voltage Vt available to other users on the line momentarily drops to a lower level. For example, the voltage may drop from 110 volts nominal, to about 70 volts. In the event that this voltage transient Vt lasts more than about 8 milliseconds (ms) (i.e., about ½ cycle), the HID lamps controlled by the voltage supply 10 will likely extinguish. On the other hand, if the voltage transient Vt lasts only about 5 ms, then the HID lamps will not likely extinguish. Thus, continued operation of the HID lamps is dependent upon the magnitude and duration of voltage transients experienced on the AC supply line. If the HID lamps do extinguish, then they need full line voltage to be applied in order to restart. In order to insure that the HID lamps are restarted by application of full line voltage in the event that they do extinguish, the HID controller 10 includes on each module 20, the sensing and control circuit 70 (previously referred to generally as a timing circuit 70) seen in FIG. 8.

Figure 8:
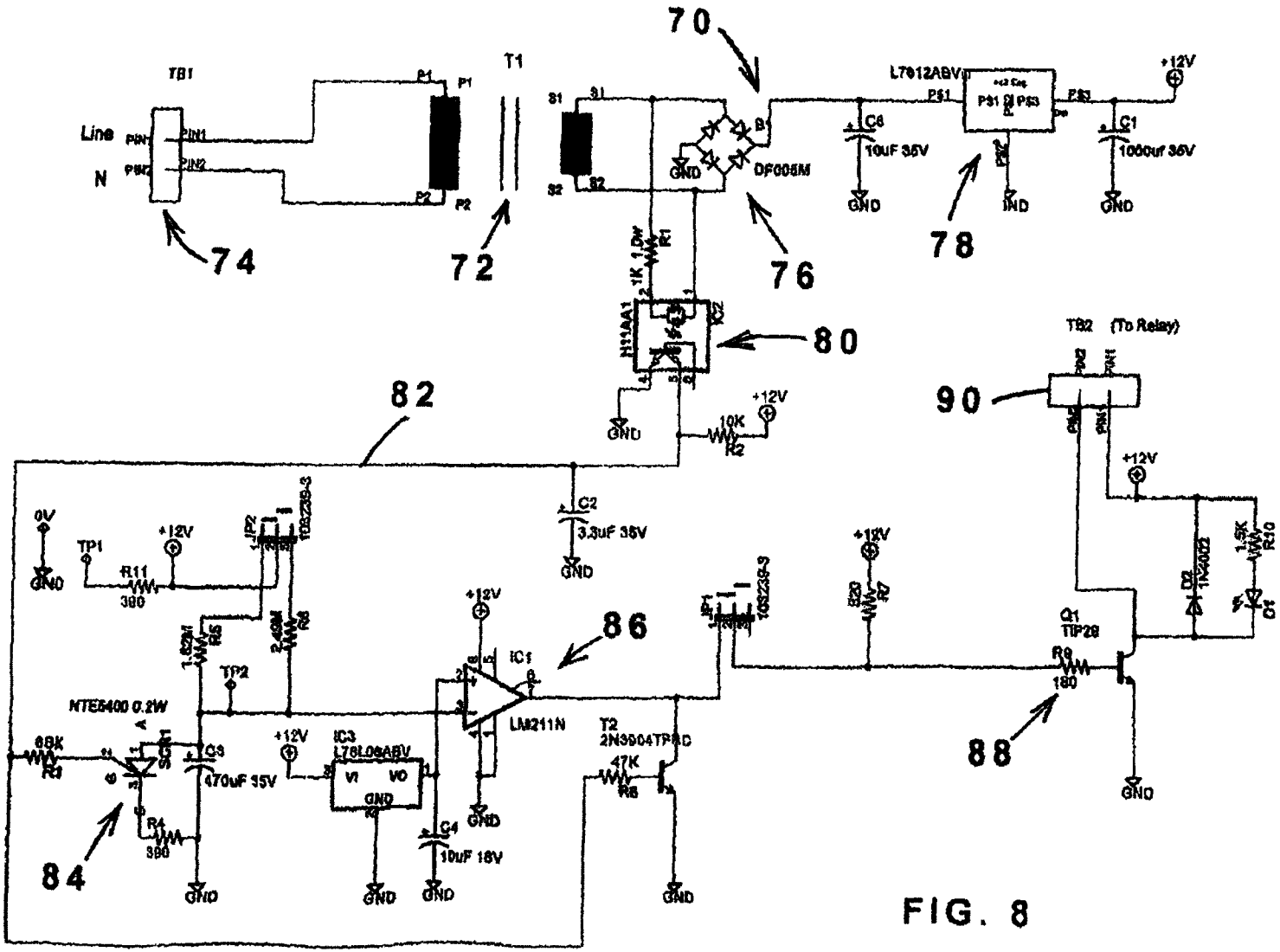
FIG. 8 a schematic illustration of a timing and sensing circuit of an HID lamp control according to this invention.

FIG. 8 schematically illustrates that the sensing and control circuit 70 is disposed on the circuit board 68, seen in FIGS. 4 and 5. Viewing FIG. 8, it is seen that this sensing and control circuit 70 includes an isolation transformer 72 receiving line voltage via a connection 74 and providing a reduced voltage level (proportionate to line voltage) to a full wave bridge rectifier 76 and hence to a regulated voltage supply 78. This regulated voltage supply 78 provides power to several other elements of the sensing and control circuit 70, as can be seen on the diagram of FIG. 8. Transformer 72 also provides power to an isolating voltage detector 80, which in this case is a light emitting diode (LED) and phototransistor type, although the invention is not so limited. This voltage detector 80 provides isolation between line voltage and the remainder of sensing and control circuit 70, and produces an output on conductor 82 to a silicon controlled rectifier (SCR) switch 84. A user-selectable jumper JP2 allows a user of the voltage control 20 to select either a 15 minute or a 30 minute warm up interval for the controlled HID lamps, depending on whether a jumper is placed across pins 1-2, or across pins 2-3.

A voltage comparator 86 provides a step-function output dependent on applied voltage from SCR 84, and in turn controls a transistorized switch circuit, generally indicated with the numeral 88. This switch circuit 88 provides an output at connection 90, which determines the state of the relay 66, thus controlling the voltage level applied to the controlled HID lamps. Finally, it should be noted that the sensing and control circuit 70 also includes a jumper JP1, which allows a user to disable the start up and transient circuit. That is, if the jumper is placed on pins 2-3, the HID lamps receive full line voltage always when turned on. When the jumper is placed on pins 1-2, the circuit operates as described to control and restart the HID lamps when needed. Also, sensing and control circuit 70 includes a time-selection capacitor C2, which by its value selects the time interval of a voltage transient to which the sensing and control circuit 70 shall react. That is, in the absence of capacitor C2, the reaction time interval for sensing and control circuit 70 would be about 1 ms. Capacitor C2 is chosen so that the time interval for a transient is about 5 to about 8 ms. For shorter transients (recalling FIG. 7), the sensing and control circuit 70 will not attempt to restart the controlled HID lamps. For transients longer than about ½ cycle (i.e., longer than about 8 ms), the sensing and control circuit 70 will apply full line voltage to the lamps for the warm up interval selected by the position of jumper JP2. In the event that a HID lamp has been extinguished by the voltage transient, then the lamp will first cool over time, and then will restart at full line voltage. If a lamp has endured the transient without being extinguished, then the full line voltage applied for the time interval selected by jumper JP2 will simply effect a minor increase in the brightness of the lamp for that time interval.

In view of the above, it is apparent that the present invention is not limited to the precise details of the preferred exemplary embodiments depicted, described, and disclosed above. Instead, this invention is intended to be limited only by the spirit and scope of the appended claims, giving full cognizance to equivalents.

I claim:

1. A voltage control transformer circuit for controlling an operating voltage level applied to a high intensity discharge (HID) lamp, said voltage control transformer circuit including a transformer, a single pole, double throw (SPDT) switch in a first position connecting a full AC line voltage to said HID lamp for starting of said HID lamp, and in a second position said SPDT switch connecting a reduced voltage less than the full AC line voltage from said transformer to said HID lamp for sustained operation of said lamp with reduced power consumption, and a timing circuit switching said SPDT switch from said second position to said first position in response to detection of a voltage transient on the AC line which is greater than a determined duration thus restoring application of the full AC line voltage to said HID lamp, whereby the voltage transient of greater than said determined duration is to extinguish said HID lamp and application of full line voltage restores operation of said HID lamp.

2. A voltage control transformer circuit according to claim 1 wherein said timing circuit includes a voltage detector producing an output to a voltage comparator, said voltage comparator providing a step-function output dependent on line voltage level, said step-function output dithering a switch circuit controlling the position of said SPDT switch.

3. A voltage control transformer circuit according to claim 2 wherein said timing circuit also includes a time-selection element which by its value selects an time interval of the voltage transient to which the timing circuit will react by dithering said switch circuit and said SPDT switch.

4. A control apparatus for starting a load device at a full AC line voltage, and for sustained operation of said load device at a reduced operating voltage with no loss of continuity between the AC line and the load device during the operating voltage reduction, said control apparatus comprising: an autotransformer having a primary winding including first and second ends, and a secondary winding having respective first and second ends; said primary winding being connected at its first end to one side of said AC line and at its second end being connected to one side of said load device;

a single pole double throw (SPDT) switch having a first switch contact connecting to said first end of said primary winding, and a common contact connecting to said load device so that when said SPDT switch is in a first position with said first switch contact and said common contact connected, said primary winding is shorted and said load device receives full line voltage;

said SPDT switch including a second switch contact connecting to a first end of said secondary winding, and a second end of said secondary winding connecting to the other side of said AC line and to the other side of said load device, so that when said SPDT switch is in a second position with said second switch contact and said common contact connected said primary and secondary windings are in series across said AC line and said load device receives reduced voltage; and a timing circuit effecting switching of said SPDT switch from said second to said first position in response to a voltage transient on the AC line which is more than a determined duration, whereby a voltage transient of greater than said determined duration is likely to disrupt operation of said load device and application of full line voltage restores operation of said load device.

5. The control apparatus of claim 4 wherein said timing circuit includes a voltage detector producing an output to a voltage comparator, said voltage comparator providing a step-function output dependent on line voltage level, said step-function output dithering a switch circuit controlling the position of said SPDT switch.

6. The control apparatus of claim 5 wherein said timing circuit also includes a time-selection element which by its value selects a time interval of the voltage transient to which the timing circuit will react by dithering said switch circuit and said SPDT switch.

7. The control apparatus of claim 6 wherein said time selection element includes a capacitor.

8. The control apparatus of claim 4 wherein said timing circuit switching said SPDT switch from said first position to said second position a certain time interval after the end of the voltage transient to which said timing circuit reacts.

9. The control apparatus of claim 4 wherein said load device includes a high intensity discharge (HID) lamp.

10. A method of effecting start up of a high intensity discharge (HID) lamp at a full AC line voltage, and of reducing the operating voltage of an HID lamp for sustained operation with reduced energy consumption with no interruption of continuity between the AC line and the HID lamp, and of restoring operation of said HID lamp following a voltage transient event which extinguishes the HID lamp, said method comprising steps of:

providing an autotransformer having a primary winding including first and second ends, and a secondary winding having respective first and second ends;

connecting said primary winding at its first end to one side of said line, and connecting said primary winding at its second end in series with said HID lighting unit;

providing a SPDT switch having a first switch contact, and connecting said first switch contact to said first end of said primary winding, connecting the common contact of said SPDT switch to said HID lighting unit so that in a first position of said SPDT switch with said first switch contact and said common contact connected said primary winding is shorted and said HID lighting unit receives the full line voltage;

connecting a second switch contact of said SPDT switch to a first end of said secondary winding, and a second end of said secondary winding connecting to the other side of said AC line and to the other side of said HID lamp, so that in the second position of said SPDT switch with said second switch contact and said common contact connected said primary and secondary windings are in series across said line and said HID lighting unit receives reduced voltage; and further including the step of providing a timing circuit effecting switching of said SPDT switch from said second to said first position in response to a voltage transient on the AC line which is more than a determined duration, whereby a voltage transient of greater than said determined duration is likely to disrupt operation of said HID lamp and application of the full AC line voltage restores operation of said HID lamp.

11. The method of claim 10 further including the steps of including in said timing circuit a voltage detector, and utilizing said voltage detector to produce an output to a voltage comparator, utilizing said voltage comparator to provide a step-function output dependent on AC line voltage level, and utilizing said step-function output to dither said SPDT from said second position to said first position in response to the AC line voltage transient greater than said determined duration.

12. The method of claim 11 further including the steps of including in said timing circuit a time-selection element, and utilizing s value of said time-selection element to set a duration of the AC line voltage transient to which the timing circuit reacts.

13. The method of claim 12 including the step of utilizing a capacitor as said time selection element.

14. The method of claim 10 wherein said timing circuit switching said SPDT switch from said first position to said second position a certain time interval after a voltage transient to which said timing circuit has reacted.

15. The method of claim 14 wherein providing said timer circuit includes steps of providing a count down timer which counts down a certain time interval following power being applied to said count down timer, and upon completion of said certain time interval utilizing said count down timer to then effect switching of said SPDT switch from said first position to said second position to reduce operating voltage provided to said HID lamp, and applying power to said count down timer upon switching of said SPDT switch from said second position to said first position so that when said count down timer reaches the end of said certain time interval and effects switching of said SPDT switch to reduce operating voltage applied to said HID lamp; said HID lamp re-started and achieved a sufficiently high temperature to sustain operation at reduced operating voltage.

16. A method of utilizing a voltage control transformer circuit to control operating voltage applied to an HID lamp, including steps of providing a voltage control transformer, and switching voltage applied to the HID lamp between a voltage level which is less than a full AC line voltage and the full AC line voltage in response to a voltage transient on the AC line which in duration is more than a determined time interval.

* * * * *